US010950368B2

(12) United States Patent
Kaczmarski et al.

(10) Patent No.: US 10,950,368 B2
(45) Date of Patent: Mar. 16, 2021

(54) I-SHAPED FILLER

(71) Applicant: Sterlite Technologies Limited, Aurangabad (IN)

(72) Inventors: Andrew Kaczmarski, Casula (AU); Darshana Bhatt, Aurangabad (IN)

(73) Assignee: STERLITE TECHNOLOGIES LIMITED, Aurangabad (IN)

( * ) Notice: Subject to any disclaimer, the term of this patent is extended or adjusted under 35 U.S.C. 154(b) by 0 days.

(21) Appl. No.: 16/723,286

(22) Filed: Dec. 20, 2019

(65) Prior Publication Data

US 2020/0126692 A1 Apr. 23, 2020

Related U.S. Application Data

(63) Continuation of application No. 15/878,860, filed on Jan. 24, 2018, now Pat. No. 10,553,333.

(30) Foreign Application Priority Data

Sep. 28, 2017 (IN) ..... 201721034599

(51) Int. Cl.

| | |
|---|---|
| ***H01B 11/08*** | (2006.01) |
| ***H01B 7/38*** | (2006.01) |
| ***H01B 3/30*** | (2006.01) |
| ***H01B 11/06*** | (2006.01) |

(52) U.S. Cl.

CPC ..... *H01B 11/08* (2013.01); *H01B 3/30* (2013.01); *H01B 7/385* (2013.01); *H01B 11/06* (2013.01)

(58) Field of Classification Search

None

See application file for complete search history.

(56) References Cited

U.S. PATENT DOCUMENTS

| | | | | | |
|---|---|---|---|---|---|
| 483,285 | A * | 9/1892 | Guilleaume | H01B 11/002 | 174/27 |
| 1,389,143 | A * | 8/1921 | Kempton | B29C 53/566 | 138/141 |
| 2,123,209 | A * | 7/1938 | Rost | H01B 11/1834 | 174/110 SR |
| 2,204,737 | A * | 6/1940 | Cuthbert | H01B 11/1834 | 174/28 |
| 3,847,725 | A * | 11/1974 | Hochner | B44C 1/1733 | 428/354 |

(Continued)

*Primary Examiner* — Jenny L Wagner
*Assistant Examiner* — Muhammed Azam

(57) ABSTRACT

A telecommunications cable includes a plurality of twisted pairs of insulated conductors. The plurality of twisted pairs of insulated conductors extends substantially along a longitudinal axis of the telecommunications cable. In addition, the telecommunications cable includes a separator. The separator separates each twisted pair of insulated conductor of the plurality of twisted pairs of insulated conductors. Moreover, the telecommunications cable includes a first layer. The first layer surrounds the separator and the plurality of twisted pairs of insulated conductors along a length of the telecommunications cable. The separator is I-shaped filler. The separator is made of low smoke zero halogen material or MDPE. The first layer is made of low smoke zero halogen material, polyethylene or poly vinyl chloride. The first layer has a thickness in a range of about 0.4 millimeter-2.5 millimeters.

21 Claims, 1 Drawing Sheet

(56) References Cited

U.S. PATENT DOCUMENTS 3,956,254 A * 5/1976 St. Eve ..... B29C 48/907 526/352.2
3,958,861 A * 5/1976 Roberts ..... G02B 6/406 385/71
4,421,867 A * 12/1983 Nojiri ..... C08J 9/0014 521/134
4,661,406 A * 4/1987 Gruhn ..... G02B 6/4407 385/103
4,807,962 A * 2/1989 Arroyo ..... G02B 6/4407 385/105
5,530,055 A * 6/1996 Needham ..... C08L 23/04 264/310
5,574,250 A * 11/1996 Hardie ..... H01B 11/005 174/102 R
5,922,155 A * 7/1999 Clouet ..... H01B 13/14 156/51
5,969,295 A * 10/1999 Boucino ..... H01B 11/06 174/113 C
6,150,612 A * 11/2000 Grandy ..... H01B 11/02 174/113 C
6,160,216 A * 12/2000 McMahon ..... H01B 7/0045 174/102 R
6,211,467 B1 * 4/2001 Berelsman ..... H01B 7/1895 174/113 C
6,239,379 B1 * 5/2001 Cotter ..... G02B 6/4416 174/110 R
6,288,340 B1 * 9/2001 Arnould ..... H01B 13/2673 174/113 R
6,365,836 B1 * 4/2002 Blouin ..... H01B 11/04 174/113 C
6,687,437 B1 * 2/2004 Starnes ..... G02B 6/4416 385/101
6,818,832 B2 * 11/2004 Hopkinson ..... H01B 11/04 174/113 C
7,145,080 B1 * 12/2006 Boisvert ..... H01B 11/06 174/110 R
7,173,189 B1 * 2/2007 Hazy ..... H01B 11/04 174/110 R
7,208,683 B2 * 4/2007 Clark ..... H01B 11/04 174/110 R
7,232,956 B2 * 6/2007 Howe ..... H01B 11/04 174/113 C
7,244,893 B2 * 7/2007 Clark ..... H01B 7/295 174/113 R
7,375,284 B2 * 5/2008 Stutzman ..... H01B 11/06 174/110 R
7,399,926 B2 * 7/2008 Park ..... H01B 11/06 174/113 C
7,592,550 B2 * 9/2009 Stutzman ..... 174/113 C
7,705,244 B2 * 4/2010 Fok ..... H01B 11/06 174/113 AS
8,183,462 B2 * 5/2012 Nordin ..... H01B 11/08 174/102 R
8,344,255 B2 * 1/2013 Wiekhorst ..... H01B 7/184 174/113 R
8,354,590 B2 * 1/2013 Nordin ..... B32B 7/12 174/110 R
8,445,787 B2 * 5/2013 Nordin ..... H01B 11/085 174/110 R
8,704,094 B1 * 4/2014 Gebs ..... H01B 3/445 174/110 PM
8,785,782 B2 * 7/2014 Kim ..... H01B 11/04 174/113 C
8,818,156 B2 * 8/2014 Nave ..... G02B 6/4471 385/134
9,251,930 B1 * 2/2016 McNutt ..... H01B 11/002
9,275,776 B1 * 3/2016 McNut ..... H01B 11/1008
9,316,801 B1 * 4/2016 Kithuka ..... G02B 6/4495
9,363,935 B1 * 6/2016 Cook ..... H05K 9/0098
9,424,963 B1 * 8/2016 McNutt ..... H01B 11/02
9,734,940 B1 * 8/2017 McNutt ..... H01B 11/1033
9,741,470 B1 * 8/2017 Cook ..... H01B 11/06
9,748,022 B2 * 8/2017 Gareis ..... H01B 11/1804
9,824,794 B1 * 11/2017 McNutt ..... H01B 11/06
9,875,825 B2 * 1/2018 Glew ..... H05K 9/0098
9,922,753 B1 * 3/2018 Cook ..... H01B 11/06
9,928,943 B1 * 3/2018 McNutt ..... H01B 11/1008
9,953,742 B2 * 4/2018 Brown ..... H01B 3/301
10,031,301 B2 * 7/2018 Glew ..... G02B 6/443
10,032,542 B2 * 7/2018 Glew ..... H01B 7/295
10,068,685 B1 * 9/2018 Cook ..... H01B 11/04
10,121,571 B1 * 11/2018 McNutt ..... H01B 11/06
10,246,639 B2 * 4/2019 Abu-Ali ..... C08K 3/22
10,249,410 B1 * 4/2019 Lanoe ..... H01B 9/003
10,276,281 B1 * 4/2019 Cook ..... H01B 11/06
10,341,125 B2 * 7/2019 Hess ..... H01B 11/02
10,388,434 B1 * 8/2019 Gebs ..... H01B 11/06
10,388,435 B2 * 8/2019 Wachtel ..... H01B 7/02
10,515,743 B1 * 12/2019 Cook ..... H01B 7/1805
2003/0111241 A1 * 6/2003 Bahlmann ..... H01B 11/085 174/367
2005/0006132 A1 * 1/2005 Clark ..... H01B 7/184 174/113 C
2005/0092515 A1 * 5/2005 Kenny ..... H01B 11/08 174/113 R
2006/0237221 A1 * 10/2006 Glew ..... H01B 11/06 174/146
2007/0044994 A1 * 3/2007 Park ..... H01B 11/06 174/113 C
2007/0044995 A1 * 3/2007 Park ..... H01B 11/06 174/113 C
2007/0144762 A1 * 6/2007 Stutzman ..... H01B 11/06 174/113 C
2007/0144763 A1 * 6/2007 Park ..... H01B 11/06 174/113 C
2007/0163800 A1 * 7/2007 Clark ..... H01B 11/06 174/113 C
2007/0193769 A1 * 8/2007 Clark ..... H01B 11/06 174/113 R
2007/0209823 A1 * 9/2007 Vexler ..... H01B 11/06 174/113 C
2007/0275583 A1 * 11/2007 McNutt ..... H01B 11/06 439/225
2009/0223694 A1 * 9/2009 Nordin ..... H01B 13/00 174/34
2010/0096179 A1 * 4/2010 Sparrowhawk ..... H01B 11/06 174/350
2011/0174516 A1 * 7/2011 Baeck ..... H01B 11/06 174/113 C
2011/0174531 A1 * 7/2011 Rubera ..... H01B 11/06 174/350
2011/0259626 A1 * 10/2011 Speer ..... H01B 11/08 174/113 C
2012/0045186 A1 * 2/2012 Wessels, Jr. ..... H01B 7/32 385/113
2012/0318558 A1 * 12/2012 Bolouri-Saransar ... H01B 13/04 174/113 R
2013/0008684 A1 * 1/2013 Weitzel ..... H01B 11/08 174/107
2014/0251652 A1 * 9/2014 Poulsen ..... H01B 11/00 174/113 C
2014/0262427 A1 * 9/2014 Brown ..... H01B 3/30 174/113 C
2015/0107872 A1 * 4/2015 Wehrli ..... H01B 11/002 174/109
2015/0357095 A1 * 12/2015 Siripurapu ..... H01B 7/295 174/99 R
2017/0192189 A1 * 7/2017 Gonzalez ..... G02B 6/4432
2018/0301245 A1 * 10/2018 Glew ..... G02B 6/443
2018/0374609 A1 * 12/2018 Wachtel ..... H01B 11/08
2019/0096545 A1 * 3/2019 Kaczmarski ..... H01B 3/30
2019/0237220 A1 * 8/2019 Kaczmarski ..... H01B 11/06
2020/0105442 A1 * 4/2020 Kaczmarski ..... H01B 7/0009

* cited by examiner

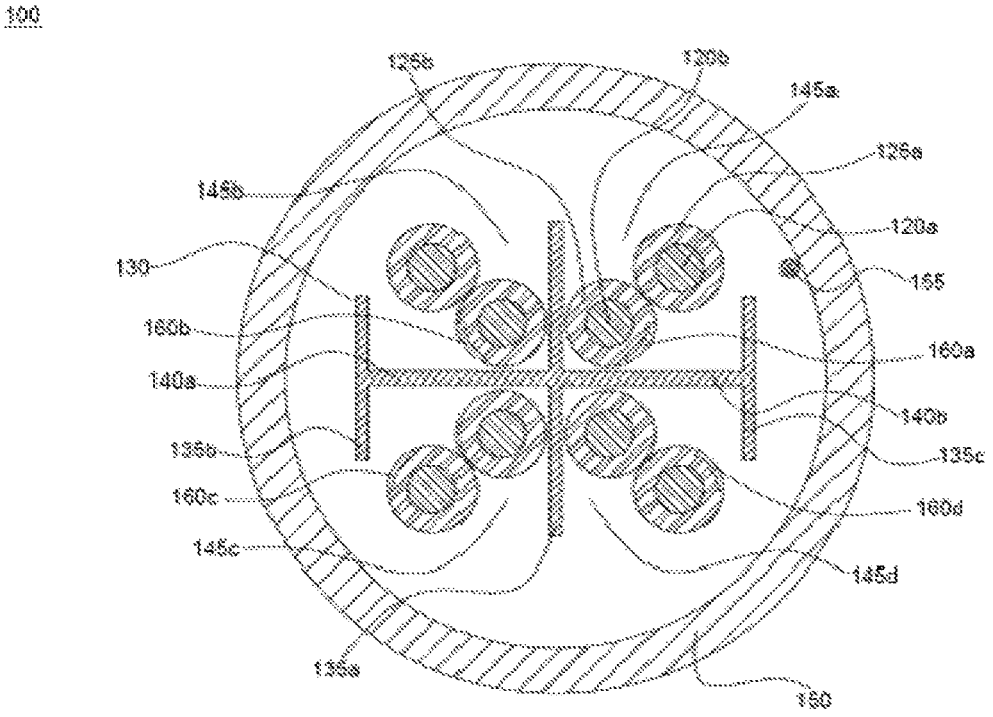
100
125b
120b
145a
125a
145b
120a
130
155
160b
160a
140a
140b
135b
135c
160c
160d
145c
145d
135a
150

I-SHAPED FILLER

TECHNICAL FIELD

The present disclosure, relates to the field of telecommunications cables. More particularly, the present disclosure relates to I-shaped filler for use in a telecommunications cable for high speed data transmission applications. The present application is based on, and claims priority from an Indian Application Number 201721034599 filed on 28 Sep. 2017 and from a parent U.S. application Ser. No. 15/878,860 filed on 24 Jan. 2018, the disclosure of which is hereby incorporated by reference herein.

BACKGROUND

With the advent of technology in the area of computers and internet, the demand for the cables capable of transmitting data at higher speed has also increased. Nowadays, various data cables are utilized for communication applications which are compliant with high performance data standards. One such type of data cables is a Category 6A U/UTP (Unshielded Twisted Pair) cables. The UTP cables are easy to handle, install, terminate and use. Typically, these UTP cables include multiple twisted pairs of insulated conductors. In addition, these UTP cables include filler or a separator. Typically, the shape of the filler may be cross type filler. The filler or separator forms four regions for disposing the twisted pair of insulated conductors. Specifically, each twisted pair of insulated conductor is disposed in a corresponding region formed by the separator such that each pair of conductor is isolated from another. Moreover, the prior art cable designs include a jacket. The jacket surrounds the filler and the insulated conductors. The filler provides protection against near end crosstalk between the pairs of insulated conductors in the data cable.

In one of the prior art with patent number U.S. Pat. No. 8,030,571 B2, a telecommunications cable is provided. The telecommunications cable includes four twisted pairs of insulated conductors. In addition, the telecommunications cable includes a separator configured to provide four quadrants in the telecommunications cable. The four twisted pairs of insulated conductors are individually disposed within the four quadrants of the separator. Moreover, the telecommunications cable includes a cable jacket. The cable jacket surrounds the four twisted pairs of insulated conductors and the separator along the length of the telecommunications cable. In addition, the separator includes a central portion, a first side portion and a second side portion. The central portion is shorter in size than the first side portion and the second side portion. Further, the separator includes a first horizontal portion and a second horizontal cross portion. The first horizontal portion and the second horizontal cross portion are perpendicular to the central portion. However, the first horizontal portion and the second horizontal cross portion are staggered or offset or dislocated from each other. Furthermore, the separator is made of a material having a material with a dielectric constant substantially the same to a dielectric constant of material used for insulation of the conductor.

In light of the above stated discussion, there exists a need for a telecommunications cable which overcomes the drawbacks of conventionally known telecommunications cable.

SUMMARY

In a first example, a separator for use in a telecommunications cable is provided. The separator includes a first section. The first section is extending along the length of the telecommunications cable. In addition, the separator includes a second section. The second section is extending along the length of the telecommunications cable. Further, the separator includes a central section. The central section is extending along the length of the telecommunications cable. Furthermore, the separator includes a first cross section. The first cross section is extending along the length of the telecommunications cable. Furthermore, the separator includes a second cross section. The second cross section is extending along the length of the telecommunications cable. The first section is a first vertical section of the separator. The second section is a second vertical section of the separator. The central section is a third vertical section of the separator. The central section is in between the first section and the second section. The first section and the second section are positioned parallel to the central section. The first section is on a first side of the central section. The second section is on a second side of the central section. The first cross section is a first horizontal section lying in between the first section and the central section. The first cross section is perpendicular to the first section and the central section. The first cross section tangibly divides the central section and the first section equally from the first side of the central section. The second cross section is a second horizontal section in between the second section and the central section. The second cross section is perpendicular to the second section and the central section. The second cross section tangibly divides the central section and the second section equally from the second side of the central section. The first section and the second section are defined by predefined dimensions. The predefined dimensions are defined by a predefined distance, a predefined height, a predefined thickness and a predefined length. The central section has a height of around the collective predefined heights of the first section and the second section. A length of the first section and the second section is substantially equal. In addition, a length of the first cross section and the second cross section is substantially equal. The separator separates each of a plurality of twisted pairs of insulated conductors.

In a second example, a separator for use in a telecommunications cable is provided. The separator includes a first section. The first section is extending along the length of the telecommunications cable. In addition, the separator includes a second section. The second section is extending along the length of the telecommunications cable. Further, the separator includes a central section. The central section is extending along the length of the telecommunications cable. Furthermore, the separator includes a first cross section. The first cross section is extending along the length of the telecommunications cable. Furthermore, the separator includes a second cross section. The second cross section is extending along the length of the telecommunications cable. The first section is a first vertical section of the separator. The second section is a second vertical section of the separator. The central section is a third vertical section of the separator. The central section is in between the first section and the second section. The first section and the second section are positioned parallel to the central section. The first section is on a first side of the central section. The second section is on a second side of the central section. The first cross section is a first horizontal section lying in between the first section and the central section. The first cross section is perpendicular to the first section and the central section. The first cross section tangibly divides the central section and the first section equally from the first side of the central section. The second cross section is a second horizontal section in between the second section and the central section. The second cross section is perpendicular to the second section and the central section. The second cross section tangibly divides the central section and the second section equally from the second side of the central section. The first section and the second section are defined by predefined dimensions. The predefined dimensions are defined by a predefined distance, a predefined height, a predefined thickness and a predefined length. The central section has a height of around the collective predefined heights of the first section and the second section. A length of the first section and the second section is substantially equal. In addition, a length of the first cross section and the second cross section is substantially equal. The separator is I-shaped filler. The I-shaped filler separates each of a plurality of twisted pairs of insulated conductors. The separator is I-shaped filler. The I-shaped filler separates each of the plurality of twisted pairs of insulated conductors. The separator is made of a material selected from a group. The group consists of low smoke zero halogen material and medium density polyethylene material. The first section and the second section have a height in a range of about 3 millimeters+−1.6 millimeters. The central section has a height in a range of about 6 millimeters+−1 millimeter. A distance between the first section and the second section is in a range of about 5.8 millimeters+−0.5 millimeters. The central section has a thickness in a range of about 0.3 millimeter-0.7 millimeter. The first section has a thickness in a range of about 0.35 millimeter-0.55 millimeter. The second section has a thickness in a range of about 0.35 millimeter-0.55 millimeter. The first cross section has a thickness in a range of about 0.5 millimeter-0.7 millimeter. The second cross section has a thickness in a range of about 0.5 millimeter-0.7 millimeter. A length of the first section and the second section is substantially equal. In addition, a length of the first cross section and the second cross section is substantially equal.

In a third example, a separator for use in a telecommunications cable is provided. The separator includes a first section. The first section is extending along the length of the telecommunications cable. In addition, the separator includes a second section. The second section is extending along the length of the telecommunications cable. Further, the separator includes a central section. The central section is extending along the length of the telecommunications cable. Furthermore, the separator includes a first cross section. The first cross section is extending along the length of the telecommunications cable. Furthermore, the separator includes a second cross section. The second cross section is extending along the length of the telecommunications cable. The first section is a first vertical section of the separator. The second section is a second vertical section of the separator. The central section is a third vertical section of the separator. The central section is in between the first section and the second section. The first section and the second section are positioned parallel to the central section. The first section is on a first side of the central section. The second section is on a second side of the central section. The first cross section is a first horizontal section lying in between the first section and the central section. The first cross section is perpendicular to the first section and the central section. The first cross section tangibly divides the central section and the first section equally from the first side of the central section. The second cross section is a second horizontal section in between the second section and the central section. The second cross section is perpendicular to the second section and the central section. The second cross section tangibly divides the central section and the second section equally from the second side of the central section. The first section and the second section are defined by predefined dimensions. The predefined dimensions are defined by a predefined distance, a predefined height, a predefined thickness and a predefined length. The central section has a height of around the collective predefined heights of the first section and the second section. A length of the first section and the second section is substantially equal. In addition, a length of the first cross section and the second cross section is substantially equal. The separator is I-shaped filler. The I-shaped filler separates each of a plurality of twisted pairs of insulated conductors. The separator is I-shaped filler. The I-shaped filler separates each of the plurality of twisted pairs of insulated conductors. The separator is made of a material selected from a group. The group consists of low smoke zero halogen material and medium density polyethylene material. The first section and the second section have a height in a range of about 3 millimeters+−1.6 millimeters. The central section has a height in a range of about 6 millimeters+−1 millimeter. A distance between the first section and the second section is in a range of about 5.8 millimeters+−0.5 millimeters. The central section has a thickness in a range of about 0.3 millimeter-0.7 millimeter. The first section has a thickness in a range of about 0.35 millimeter-0.55 millimeter. The second section has a thickness in a range of about 0.35 millimeter-0.55 millimeter. The first cross section has a thickness in a range of about 0.5 millimeter-0.7 millimeter. The second cross section has a thickness in a range of about 0.5 millimeter-0.7 millimeter. A length of the first section and the second section is substantially equal. In addition, a length of the first cross section and the second cross section is substantially equal. The separator is characterized by a dielectric constant. The dielectric has a first value and a second value. The dielectric constant has the first value in a range of about 3.5+−0.3 when the separator is made of low smoke zero halogen. The dielectric constant has the second value in a range of about 2.3+−0.3 when the separator is made of medium density polyethylene. The separator is characterized by an elongation. The elongation has a first value and a second value. The elongation has the first value of about 300%-800% when the separator is made of medium density polyethylene. The elongation has the second value of about 100%-300% when the separator is made of low smoke zero halogen. The separator is characterized by a tensile strength. The tensile strength has a first value and a second value. The tensile strength has the first value of about 12-20 N/Sq mm when the separator is made of medium density polyethylene. The tensile strength has the second value of about 7-15 N/Sq mm when the separator is made of low smoke zero halogen.

In an embodiment of the present disclosure, the separator is made of a material selected from a group consisting of low smoke zero halogen and medium density polyethylene.

In an embodiment of the present disclosure, the separator is I-shaped filler.

In an embodiment of the present disclosure, the separator has a dielectric constant of about 3.5+−0.3 when the separator is made of low smoke zero halogen.

In an embodiment of the present disclosure, the separator has a dielectric constant of about 2.3+−0.3 when the separator is made of medium density polyethylene.

In an embodiment of the present disclosure, the separator has an elongation of about 300%-800% when the separator is made of medium density polyethylene.

In an embodiment of the present disclosure, the separator has an elongation of about 100%-300% when the separator is made of low smoke zero halogen.

In an embodiment of the present disclosure, the separator has a tensile strength of about 12-20 N/Sq mm when the separator is made of medium density polyethylene.

In an embodiment of the present disclosure, the separator has a tensile strength of about 7-15 N/Sq mm when the separator is made of low smoke zero halogen.

In an embodiment of the present disclosure, the first section and the second section have a height in a range of about 3 millimeters+−1.6 millimeters.

In an embodiment of the present disclosure, the central section has a height in a range of about 6 millimeters+−1 millimeter.

In an embodiment of the present disclosure, the distance between the first section and the second section is in a range of about 5.8 millimeters+−0.5 millimeters.

In an embodiment of the present disclosure, the central section has a thickness in a range of about 0.3 millimeter-0.7 millimeter.

In an embodiment of the present disclosure, the first section has a thickness in a range of about 0.35 millimeter-0.55 millimeter.

In an embodiment of the present disclosure, the second section has a thickness in a range of about 0.35 millimeter-0.55 millimeter.

In an embodiment of the present disclosure, the first cross section has a thickness in a range of about 0.5 millimeter-0.7 millimeter.

In an embodiment of the present disclosure, the second cross section has a thickness in a range of about 0.5 millimeter-0.7 millimeter.

In a fourth example, a telecommunications cable is provided. The telecommunications cable includes a plurality of twisted pairs of insulated conductors. The plurality of twisted pairs of insulated conductors extends substantially along a longitudinal axis of the telecommunications cable. In addition, the telecommunications cable includes a separator. The separator separates each twisted pair of insulated conductor of the plurality of twisted pairs of insulated conductors. Moreover, the telecommunications cable includes a first layer. The first layer surrounds the separator and the plurality of twisted pairs of insulated conductors along a length of the telecommunications cable. Each of the plurality of twisted pairs of insulated conductors includes an electrical conductor and an insulation layer. The insulation layer surrounds the electrical conductor. The electrical conductor is made of copper. The separator comprises a first section, a second section and a central section. The first section is a first vertical section of the separator. The second section is a second vertical section of the separator. The central section is a third vertical section of the separator. The central section is in between the first section and the second section. The first section and the second section are positioned parallel to the central section. The first section is on a first side of the central section. The second section is on a second side of the central section. The separator comprises a first cross section and a second cross section. The first cross section is a first horizontal section lying in between the first section and the central section. The first cross section is perpendicular to the first section and the central section. The first cross section tangibly divides the central section and the first section equally from the first side of the central section. The second cross section is a second horizontal section lying in between the second section and the central section. The second cross section is perpendicular to the second section and the central section. The second cross section tangibly divides the central section and the second section equally from the second side of the central section. The first section and the second section are defined by predefined dimensions. The predefined dimensions are defined by a predefined distance, a predefined height, a predefined thickness and a predefined length. The central section has a height of around the collective predefined heights of the first section and the second section. A length of the first section and the second section is substantially equal and a length of the first cross section and the second cross section is substantially equal.

In a fifth example, a telecommunications cable is provided. The telecommunications cable includes a plurality of twisted pairs of insulated conductors. The plurality of twisted pairs of insulated conductors extends substantially along a longitudinal axis of the telecommunications cable. In addition, the telecommunications cable includes a separator. The separator separates each twisted pair of insulated conductor of the plurality of twisted pairs of insulated conductors. Moreover, the telecommunications cable includes a first layer. The first layer surrounds the separator and the plurality of twisted pairs of insulated conductors along a length of the telecommunications cable. Each of the plurality of twisted pairs of insulated conductors includes an electrical conductor and an insulation layer. The insulation layer surrounds the electrical conductor. The electrical conductor is made of copper. The separator is made of a material selected from a group. The group consists of low smoke zero halogen material and medium density polyethylene material. The separator comprises a first section, a second section and a central section. The first section is a first vertical section of the separator. The second section is a second vertical section of the separator. The central section is a third vertical section of the separator. The central section is in between the first section and the second section. The first section and the second section are positioned parallel to the central section. The first section is on a first side of the central section. The second section is on a second side of the central section. The separator comprises a first cross section and a second cross section. The first cross section is a first horizontal section lying in between the first section and the central section. The first cross section is perpendicular to the first section and the central section. The first cross section tangibly divides the central section and the first section equally from the first side of the central section. The second cross section is a second horizontal section lying in between the second section and the central section. The second cross section is perpendicular to the second section and the central section. The second cross section tangibly divides the central section and the second section equally from the second side of the central section. The first section and the second section are defined by predefined dimensions. The predefined dimensions are defined by a predefined distance, a predefined height, a predefined thickness and a predefined length. The central section has a height of around the collective predefined heights of the first section and the second section. A length of the first section and the second section is substantially equal and a length of the first cross section and the second cross section is substantially equal. The first section and the second section have a height in a range of about 3 millimeters+−1.6 millimeters. The central section has a height in a range of about 6 millimeters+−1 millimeter. A distance between the first section and the second section is in a range of about 5.8 millimeters+−0.5 millimeters. The central section has a thickness in a range of about 0.3 millimeter-0.7 millimeter. The first section has a thickness in a range of about 0.35 millimeter-0.55 millimeter. The second section has a thickness in a range of about 0.35 millimeter-0.55 millimeter. The first cross section has a thickness in a range of about 0.5 millimeter-0.7 millimeter. The second cross section has a thickness in a range of about 0.5 millimeter-0.7 millimeter. A length of the first section and the second section is substantially equal. In addition, a length of the first cross section and the second cross section is substantially equal. The telecommunications cable has a diameter in a range of about 7.8 millimeters±0.7 millimeter.

In a sixth example, a telecommunications cable is provided. The telecommunications cable includes a plurality of twisted pairs of insulated conductors. The plurality of twisted pairs of insulated conductors extends substantially along a longitudinal axis of the telecommunications cable. In addition, the telecommunications cable includes a separator. The separator separates each twisted pair of insulated conductor of the plurality of twisted pairs of insulated conductors. Moreover, the telecommunications cable includes a first layer. The first layer surrounds the separator and the plurality of twisted pairs of insulated conductors along a length of the telecommunications cable. Each of the plurality of twisted pairs of insulated conductors includes an electrical conductor and an insulation layer. The insulation layer surrounds the electrical conductor. The electrical conductor is made of copper. The separator is made of a material selected from a group. The group consists of low smoke zero halogen material and medium density polyethylene material. The separator comprises a first section, a second section and a central section. The first section is a first vertical section of the separator. The second section is a second vertical section of the separator. The central section is a third vertical section of the separator. The central section is in between the first section and the second section. The first section and the second section are positioned parallel to the central section. The first section is on a first side of the central section. The second section is on a second side of the central section. The separator comprises a first cross section and a second cross section. The first cross section is a first horizontal section lying in between the first section and the central section. The first cross section is perpendicular to the first section and the central section. The first cross section tangibly divides the central section and the first section equally from the first side of the central section. The second cross section is a second horizontal section lying in between the second section and the central section. The second cross section is perpendicular to the second section and the central section. The second cross section tangibly divides the central section and the second section equally from the second side of the central section. The first section and the second section are defined by predefined dimensions. The predefined dimensions are defined by a predefined distance, a predefined height, a predefined thickness and a predefined length. The central section has a height of around the collective predefined heights of the first section and the second section. A length of the first section and the second section is substantially equal and a length of the first cross section and the second cross section is substantially equal. The first section and the second section have a height in a range of about 3 millimeters+−1.6 millimeters. The central section has a height in a range of about 6 millimeters+−1 millimeter. A distance between the first section and the second section is in a range of about 5.8 millimeters+−0.5 millimeters. The central section has a thickness in a range of about 0.3 millimeter-0.7 millimeter. The first section has a thickness in a range of about 0.35 millimeter-0.55 millimeter. The second section has a thickness in a range of about 0.35 millimeter-0.55 millimeter. The first cross section has a thickness in a range of about 0.5 millimeter-0.7 millimeter. The second cross section has a thickness in a range of about 0.5 millimeter-0.7 millimeter. A length of the first section and the second section is substantially equal. In addition, a length of the first cross section and the second cross section is substantially equal. The telecommunications cable has a diameter in a range of about 7.8 millimeters±0.7 millimeter. The electrical conductor has a cross sectional diameter in a range of about 0.570 millimeter±0.050 millimeter. The insulation layer has a thickness in a range of about 0.15 millimeters-0.40 millimeters. The first layer has a thickness in a range of about 0.4 millimeter-2.5 millimeter.

In an embodiment of the present disclosure, the separator is made of a material selected from a group consisting of low smoke zero halogen material and medium density polyethylene material.

In an embodiment of the present disclosure, the electrical conductor has a cross sectional diameter in a range of about 0.570 millimeter±0.050 millimeter.

In an embodiment of the present disclosure, the insulation layer is made of a material selected from a group of high density polyethylene and foamed high density polyethylene. The insulation layer has a thickness in a range of about 0.15 millimeters-0.40 millimeters.

In an embodiment of the present disclosure, the first layer is made of a material selected from a group of low smoke zero halogen material, polyvinyl chloride and polyethylene. The first layer has a thickness in a range of about 0.4 millimeter-2.5 millimeter.

In an embodiment of the present disclosure, the telecommunications cable further includes one or more ripcords placed inside a core of the telecommunications cable. The one or more ripcords lie substantially along the longitudinal axis of the telecommunications cable. The one or more ripcords facilitate stripping of the first layer. The one or more ripcords are made of a material selected from a group. The group consists of nylon and polyester based twisted yarns.

In an embodiment of the present disclosure, the low smoke zero halogen material of the separator has a greater dielectric constant than the high density polyethylene material for the insulation layer of each of the plurality of twisted pairs of insulated conductors.

In an embodiment of the present disclosure, the insulation layer is made of a material selected from a group. The group consists of polypropylene, foamed polyethylene, foamed polypropylene and fluoro-polymer.

In an embodiment of the present disclosure, the first section and the second section have a height in a range of about 3 millimeters+−1.6 millimeters.

In an embodiment of the present disclosure, the central section has a height in a range of about 6 millimeters+−1 millimeter.

In an embodiment of the present disclosure, the distance between the first section and the second section is in a range of about 5.8 millimeters+−0.5 millimeters.

In an embodiment of the present disclosure, the central section has a thickness in a range of about 0.3 millimeter-0.7 millimeter.

In an embodiment of the present disclosure, the first section has a thickness in a range of about 0.35 millimeter-0.55 millimeter.

In an embodiment of the present disclosure, the second section has a thickness in a range of about 0.35 millimeter-0.55 millimeter.

In an embodiment of the present disclosure, the first cross section has a thickness in a range of about 0.5 millimeter-0.7 millimeter.

In an embodiment of the present disclosure, the second cross section has a thickness in a range of about 0.5 millimeter-0.7 millimeter.

In an embodiment of the present disclosure, the telecommunications cable has a diameter in a range of about 7.8 millimeters±0.7 millimeter.

BRIEF DESCRIPTION OF FIGURES

Having thus described the invention in general terms, reference will now be made to the accompanying drawings, which are not necessarily drawn to scale, and wherein:

FIG. 1 illustrates a cross sectional view of a telecommunications cable, in accordance with an embodiment of the present disclosure.

It should be noted that the accompanying FIGURES are intended to present illustrations of exemplary embodiments of the present disclosure. These FIGURES are not intended to limit the scope of the present disclosure. It should also be noted that accompanying FIGURES are not necessarily drawn to scale.

DETAILED DESCRIPTION

In the following description, for purposes of explanation, numerous specific details are set forth in order to provide a thorough understanding of the present technology. It will be apparent, however, to one skilled in the art that the present technology can be practiced without these specific details. In other instances, structures and devices are shown in block diagram form only in order to avoid obscuring the present technology.

Reference in this specification to "one embodiment" or "an embodiment" means that a particular feature, structure, or characteristic described in connection with the embodiment is included in at least one embodiment of the present technology. The appearance of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not other embodiments.

Moreover, although the following description contains many specifics for the purposes of illustration, anyone skilled in the art will appreciate that many variations and/or alterations to said details are within the scope of the present technology. Similarly, although many of the features of the present technology are described in terms of each other, or in conjunction with each other, one skilled in the art will appreciate that many of these features can be provided independently of other features. Accordingly, this description of the present technology is set forth without any loss of generality to, and without imposing limitations upon, the present technology.

FIG. 1 illustrates a cross sectional view of a telecommunications cable 100, in accordance with an embodiment of the present disclosure. In general, the telecommunications cable 100 is a type of guided transmission media that allows baseband transmissions from a transmitter to a receiver. In addition, the telecommunications cable 100 is utilized for mass data transmission of local area network. Moreover, the telecommunications cable 100 is used for high speed data rate transmission. The high speed data rate transmission includes 1000BASE-T (Gigabit Ethernet) and 10 GBASE-T (10-Gigabit Ethernet) or other standards. The telecommunications cable 100 is used for a wide variety of applications. The telecommunications cable 100 is an unshielded twisted pair telecommunications cable. In general, the unshielded twisted pair telecommunications cable is a cable with two conductors of a single circuit twisted together. The electrical conductors are twisted together for the purposes of canceling out electromagnetic interference from internal and external sources. The telecommunications cable 100 is associated with a longitudinal axis (not shown in FIGURE). The longitudinal axis of the telecommunications cable 100 passes through the geometrical center of the cross section of the telecommunications cable 100. The telecommunications cable 100 is a Category 6A U/UTP (Unshielded Twisted Pair) cable.

The telecommunications cable 100 includes a plurality of twisted pairs of insulated conductors, a separator 130, a first layer 150, a ripcord 155 and plurality of identification stripes 160*a-d*. The plurality of twisted pairs of insulated conductors includes a plurality of electrical conductors 120*a-b* and insulation layers 125*a-b*. The separator 130 includes a central section 135*a*, a first section 135*b*, a second section 135*c*, cross section 140*a-b* and four volumetric sections 145*a-d*. In addition, the plurality of twisted pairs of insulated conductors includes more pairs of twisted insulated conductors. The above combination of structural elements enables an improvement in a plurality of characteristics of the telecommunications cable 100. The plurality of characteristics includes electrical properties and transmission characteristics. The electrical properties include input impedance, conductor resistance, mutual capacitance, resistance unbalance, capacitance unbalance, propagation delay and delay skew. The transmission characteristics include attenuation, return loss, near end crosstalk, attenuation to crosstalk ratio far end, alien cross talk, power sum attenuation to crosstalk ratio at far end, Transverse conversion loss (TCL) and power sum alien near end cross talk (PSANEXT).

In general, the input impedance is the ratio of the amplitudes of voltage and current of a wave travelling in one direction in the absence of reflections in the other direction. In an embodiment of the present disclosure, the input impedance of the telecommunications cable 100 is 100 ohm±15 ohm. In another embodiment of the present disclosure, the telecommunications cable 100 has any other suitable value of characteristic impedance. In general, the conductor resistance is a measure of the difficulty to pass electric current through a conductor. In an embodiment of the present disclosure, the conductor resistance of the telecommunications cable 100 is less than or equal to 9.38 ohm per 100 meters. In another embodiment of the present disclosure, the telecommunications cable 100 has any other suitable value of the conductor resistance.

In general, the mutual capacitance is intentional or unintentional capacitance taking place between two charge-holding objects or conductors in which the current passing through one passes over into the other conductor. In an embodiment of the present disclosure, the mutual capacitance of the telecommunications cable 100 is less than 5.6 nanoFarads per 100 meters. In another embodiment of the present disclosure, the telecommunications cable 100 has any other suitable value of the mutual capacitance. In general, the resistance unbalance is a measure of the difference in resistance between two conductors in a cabling system. In an embodiment of the present disclosure, the telecommunications cable 100 has the resistance unbalance of maximum 5 percent. In another embodiment of the present disclosure, the telecommunications cable 100 has any other suitable value of the resistance unbalance.

In general, the capacitance unbalance is a measure of difference in capacitance between two conductors in a cabling system. In an embodiment of the present disclosure, the capacitance unbalance of the telecommunications cable 100 is 330 picoFarads per 100 meter. In another embodiment of the present disclosure the telecommunications cable 100 has any other suitable value of capacitance unbalance. In general, the propagation delay is equivalent to an amount of time that passes between when a signal is transmitted and when it is received on the other end of a cabling channel. In an embodiment of the present disclosure, the propagation delay for the telecommunications cable 100 is 570 nanoseconds at a frequency of 1 MHz. In general, the delay skew is a difference in propagation delay between any two conductor pairs within the same cable. In an embodiment of the present disclosure, the delay skew of the telecommunications cable 100 is less than 45 nanoseconds. In another embodiment of the present disclosure, the telecommunications cable 100 has any other suitable value of the delay skew.

In general, the attenuation refers to reduction in the strength of a signal travelling through the telecommunications cable 100. In general, the return loss is the measurement of the amount of signal that is reflected back toward the transmitter. In general, the near end crosstalk is an error condition describing the occurrence of a signal from one wire pair radiating to and interfering with the signal of another wire pair. In general, the attenuation to cross talk ratio far end is a measure of signal received at the far end of the telecommunications cable 100. The ratio provides an indication of the interfering signal induced by adjacent conductor pairs in the same telecommunications cable 100. The alien crosstalk is electromagnetic noise occurring in a telecommunications cable 100 running alongside one or more other signal-carrying cables. The term "alien" is used as alien crosstalk occurs between different cables in a group or bundle and not between individual wires or circuits within a single cable. In general, the Transverse Conversion Loss is the ratio (in dB) of a common-mode voltage measured on a wire pair relative to a differential-mode voltage applied to the same end of the pair. The TCL value shows how well the impedances of the pair's conductors are balanced. In an embodiment of the present disclosure, the Transverse Conversion Loss is 40 dB at a frequency of 1 MHz. The power sum alien near end crosstalk (PSANEXT) is a measurement of interference generated in a test cable by a number of surrounding cables. The power sum near end crosstalk is measured at the same end of the cable as the interfering transmitter.

The telecommunications cable 100 transmits data at a plurality of operational frequencies. The plurality of operational frequencies includes 1 MegaHertz (hereinafter MHz), 4 MHz, 10 MHz, 16 MHz, 20 MHz, 31.25 MHz, 62.5 MHz, 100 MHz, 200 MHz, 250 MHz, 300 MHz and 500 MHz.

In an embodiment of the present disclosure, the maximum attenuation of the telecommunications cable 100 is 2.1 decibels (hereinafter dB) per 100 meters at 1 MHz. In an embodiment of the present disclosure, the return loss of the telecommunications cable 100 is 20 dB at 1 MHz. In an embodiment of the present disclosure, the near end crosstalk of the telecommunications cable 100 is 74.3 dB. In an embodiment of the present disclosure, the power sum near end crosstalk of the telecommunications cable 100 is 72.3 dB at 1 MHz. In an embodiment of the present disclosure, the attenuation to crosstalk ratio far end of the telecommunications cable 100 is 67.8 dB at 1 MHz. In an embodiment of the present disclosure, the power sum attenuation to crosstalk ratio far end of the telecommunications cable 100 is 64.8 dB at 1 MHz. In another embodiment of the present disclosure, the telecommunications cable 100 may have any other suitable value of the transmission characteristics at 1 MHz.

In another embodiment of the present disclosure, the maximum attenuation of the telecommunications cable 100 is 3.8 dB per 100 meters at 4 MHz. In another embodiment of the present disclosure, the return loss of the telecommunications cable 100 is 23 dB at 4 MHz. In another embodiment of the present disclosure, the near end crosstalk of the telecommunications cable 100 is 65.3 dB at 4 MHz. In another embodiment of the present disclosure, the power sum near end crosstalk of the telecommunications cable 100 is 63.3 dB at 4 MHz. In another embodiment of the present disclosure, the attenuation to crosstalk ratio far end of the telecommunications cable 100 is 55.8 dB at 1 MHz. In another embodiment of the present disclosure, the power sum attenuation to crosstalk ratio far end of the telecommunications cable 100 is 52.8 dB at 1 MHz. In yet another embodiment of the present disclosure, the telecommunications cable 100 may have any other suitable value transmission characteristics at 4 MHz.

In yet another embodiment of the present disclosure, the maximum attenuation of the telecommunications cable 100 is 5.9 dB per 100 meters at 10 MHz. In yet another embodiment of the present disclosure, the return loss of the telecommunications cable 100 is 25 dB at 10 MHz. In yet another embodiment of the present disclosure, the near end crosstalk of the telecommunications cable 100 is 59.3 dB at 10 MHz. In yet another embodiment of the present disclosure, the power sum near end crosstalk of the telecommunications cable 100 is 57.3 dB at 10 MHz. In yet another embodiment of the present disclosure, the attenuation to crosstalk ratio far end of the telecommunications cable 100 is 47.8 dB at 10 MHz. In yet another embodiment of the present disclosure, the power sum attenuation to crosstalk ratio far end of the telecommunications cable 100 is 44.8 dB at 10 MHz. In yet another embodiment of the present disclosure, the transmissions cable 100 may have any other suitable value transmission characteristics at 10 MHz.

In yet another embodiment of the present disclosure, the maximum attenuation of the telecommunications cable 100 is 7.5 dB per 100 meters at 16 MHz. In yet another embodiment of the present disclosure, the return loss of the telecommunications cable 100 is 25 dB at 16 MHz. In yet another embodiment of the present disclosure, the near end crosstalk of the telecommunications cable 100 is 56.2 dB at 16 MHz. In yet another embodiment of the present disclosure, the power sum near end crosstalk of the telecommunications cable 100 is 54.2 dB at 16 MHz. In yet another embodiment of the present disclosure, the attenuation to crosstalk ratio far end of the telecommunications cable 100 is 43.7 dB at 16 MHz. In yet another embodiment of the present disclosure, the power sum attenuation to crosstalk ratio far end of the telecommunications cable 100 is 40.7 dB at 16 MHz. In yet another embodiment of the present disclosure, the telecommunications cable 100 may have any other suitable value transmission characteristics at 16 MHz.

In yet another embodiment of the present disclosure, the maximum attenuation of the telecommunications cable 100 is 8.4 dB per 100 meters at 20 MHz. In yet another embodiment of the present disclosure, the return loss of the telecommunications cable 100 is 25 dB at 20 MHz. In yet another embodiment of the present disclosure, the near end crosstalk of the telecommunications cable 100 is 54.8 dB at 20 MHz. In yet another embodiment of the present disclosure, the power sum near end crosstalk of the telecommunications cable 100 is 52.8 dB at 20 MHz. In yet another embodiment of the present disclosure, the attenuation to crosstalk ratio far end of the telecommunications cable 100 is 41.8 dB at 20 MHz. In yet another embodiment of the present disclosure, the power sum attenuation to crosstalk ratio far end of the telecommunications cable 100 is 38.8 dB at 20 MHz. In yet another embodiment of the present disclosure, the telecommunications cable 100 may have any other suitable value transmission characteristics at 20 MHz.

In yet another embodiment of the present disclosure, the maximum attenuation of the telecommunications cable 100 is 10.5 dB per 100 meters at 31.25 MHz. In yet another embodiment of the present disclosure, the return loss of the telecommunications cable 100 is 23.6 dB at 31.25 MHz. In yet another embodiment of the present disclosure, the near end crosstalk of the telecommunications cable 100 is 51.9 dB at 31.25 MHz. In yet another embodiment of the present disclosure, the power sum near end crosstalk of the telecommunications cable 100 is 49.9 dB at 31.25 MHz. In yet another embodiment of the present disclosure, the attenuation to crosstalk ratio far end of the telecommunications cable 100 is 37.9 dB at 31.25 MHz. In yet another embodiment of the present disclosure, the power sum attenuation to crosstalk ratio far end of the telecommunications cable 100 is 34.9 dB at 31.25 MHz. In yet another embodiment of the present disclosure, the telecommunications cable 100 may have any other suitable value transmission characteristics at 31.25 MHz.

In yet another embodiment of the present disclosure, the maximum attenuation of the telecommunications cable 100 is 15 dB per 100 meters at 62.5 MHz. In yet another embodiment of the present disclosure, the return loss of the telecommunications cable 100 is 21.5 dB at 62.5 MHz. In yet another embodiment of the present disclosure, the near end crosstalk of the telecommunications cable 100 is 47.4 dB at 62.5 MHz. In yet another embodiment of the present disclosure, the power sum near end crosstalk of the telecommunications cable 100 is 45.4 dB at 62.5 MHz. In yet another embodiment of the present disclosure, the attenuation to crosstalk ratio far end of the telecommunications cable 100 is 31.9 dB at 62.5 MHz. In yet another embodiment of the present disclosure, the power sum attenuation to crosstalk ratio far end of the telecommunications cable 100 is 28.9 dB at 62.5 MHz. In yet another embodiment of the present disclosure, the telecommunications cable 100 may have any other suitable value transmission characteristics at 62.5 MHz.

In yet another embodiment of the present disclosure, the maximum attenuation of the telecommunications cable 100 is 19.1 dB per 100 meters at 100 MHz. The return loss of the telecommunications cable 100 is 20.1 dB at 100 MHz. The near end crosstalk of the telecommunications cable 100 is 44.3 dB at 100 MHz. The power sum near end crosstalk of the telecommunications cable 100 is 42.3 dB at 100 MHz. The attenuation to crosstalk ratio far end of the telecommunications cable 100 is 27.8 dB at 100 MHz. The power sum attenuation to crosstalk ratio far end of the telecommunications cable 100 is 24.8 dB at 100 MHz. In yet another embodiment of the present disclosure, the telecommunications cable 100 may have any other suitable value transmission characteristics at 100 MHz.

In yet another embodiment of the present disclosure, the maximum attenuation of the telecommunications cable 100 is 27.6 dB per 100 meters at 200 MHz. In yet another embodiment of the present disclosure, the return loss of the telecommunications cable 100 is 18 dB at 200 MHz. In yet another embodiment of the present disclosure, the near end crosstalk of the telecommunications cable 100 is 39.8 dB at 200 MHz. In yet another embodiment of the present disclosure, the power sum near end crosstalk of the telecommunications cable 100 is 37.8 dB at 200 MHz. In yet another embodiment of the present disclosure, the attenuation to crosstalk ratio far end of the telecommunications cable 100 is 21.8 dB at 200 MHz. In yet another embodiment of the present disclosure, the power sum attenuation to crosstalk ratio far end of the telecommunications cable 100 is 18.8 dB at 200 MHz. In yet another embodiment of the present disclosure, the telecommunications cable 100 may have any other suitable value transmission characteristics at 200 MHz.

In yet another embodiment of the present disclosure, the maximum attenuation of the telecommunications cable 100 is 31.1 dB per 100 meters at 250 MHz. In yet another embodiment of the present disclosure, the return loss of the telecommunications cable 100 is 17.3 dB at 250 MHz. In yet another embodiment of the present disclosure, the near end crosstalk of the telecommunications cable 100 is 38.3 dB at 250 MHz. In yet another embodiment of the present disclosure, the power sum near end crosstalk of the telecommunications cable 100 is 36.3 dB at 250 MHz. In yet another embodiment of the present disclosure, the attenuation to crosstalk ratio far end of the telecommunications cable 100 is 19.8 dB at 250 MHz. In yet another embodiment of the present disclosure, the power sum attenuation to crosstalk ratio far end of the telecommunications cable 100 is 16.8 dB at 250 MHz. In yet another embodiment of the present disclosure, the telecommunications cable 100 may have any other suitable value transmission characteristics at 250 MHz.

In yet another embodiment of the present disclosure, the maximum attenuation of the telecommunications cable 100 is 34.3 dB per 100 meters at 300 MHz. In yet another embodiment of the present disclosure, the return loss of the telecommunications cable 100 is 16.8 dB at 300 MHz. In yet another embodiment of the present disclosure, the near end crosstalk of the telecommunications cable 100 is 38.1 dB at 300 MHz. In yet another embodiment of the present disclosure, the power sum near end crosstalk of the telecommunications cable 100 is 35.1 dB at 300 MHz. In yet another embodiment of the present disclosure, the attenuation to crosstalk ratio far end of the telecommunications cable 100 is 18.3 dB at 300 MHz. In yet another embodiment of the present disclosure, the power sum attenuation to crosstalk ratio far end of the telecommunications cable 100 is 15.3 dB at 300 MHz. In yet another embodiment of the present disclosure, the telecommunications cable 100 may have any other suitable value transmission characteristics at 300 MHz.

In yet another embodiment of the present disclosure, the maximum attenuation of the telecommunications cable 100 is 45.3 dB per 100 meters at 500 MHz. In yet another embodiment of the present disclosure, the return loss of the telecommunications cable 100 is 15.2 dB at 500 MHz. In yet another embodiment of the present disclosure, the near end crosstalk of the telecommunications cable 100 is 34.8 dB at 500 MHz. In yet another embodiment of the present disclosure, the power sum near end crosstalk of the telecommunications cable 100 is 31.8 dB at 500 MHz. In yet another embodiment of the present disclosure, the attenuation to crosstalk ratio far end of the telecommunications cable 100 is 13.8 dB at 500 MHz. In yet another embodiment of the present disclosure, the power sum attenuation to crosstalk ratio far end of the telecommunications cable 100 is 10.8 dB at 500 MHz. In yet another embodiment of the present disclosure, the telecommunications cable 100 may have any other suitable value transmission characteristics at 500 MHz.

In an embodiment of the present disclosure, the telecommunications cable 100 has the power sum alien near end cross talk loss of 67.0 dB at a frequency of 1 MHz. In another embodiment of the present disclosure, the telecommunications cable 100 has the power sum alien near end cross talk loss of 67.0 dB at a frequency of 4 MHz. In yet another embodiment of the present disclosure, the telecommunications cable 100 has the power sum alien near end crosstalk loss of 67.0 dB at a frequency of 8 MHz. In yet another embodiment of the present disclosure, the telecommunications cable 100 has the power sum alien near end cross talk loss of 67.0 dB at a frequency of 10 MHz. In yet another embodiment of the present disclosure, the telecommunications cable 100 has the power sum alien near end cross talk loss of 67.0 dB at a frequency of 16 MHz. In yet another embodiment of the present disclosure, the telecommunications cable 100 has the power sum alien near end cross talk loss of 67.0 dB at a frequency of 20 MHz.

In yet another embodiment of the present disclosure, the telecommunications cable 100 has the power sum alien near end cross talk loss of 66.0 dB at a frequency of 25 MHz.

In yet another embodiment of the present disclosure, the telecommunications cable 100 has the power sum alien near end cross talk loss of 65.1 dB at a frequency of 31.25 MHz.

In yet another embodiment of the present disclosure, the telecommunications cable 100 has the power sum alien near end cross talk loss of 62.0 dB at a frequency of 62.5 MHz.

In yet another embodiment of the present disclosure, the telecommunications cable 100 has the power sum alien near end cross talk loss of 60.0 dB at a frequency of 100 MHz.

In yet another embodiment of the present disclosure, the telecommunications cable 100 has the power sum alien near end cross talk loss of 55.5 dB at a frequency of 200 MHz.

In yet another embodiment of the present disclosure, the telecommunications cable 100 has the power sum alien near end cross talk loss of 54.0 dB at a frequency of 250 MHz.

In yet another embodiment of the present disclosure, the telecommunications cable 100 has the power sum alien near end cross talk loss of 52.8 dB at a frequency of 300 MHz.

In yet another embodiment of the present disclosure, the telecommunications cable 100 has the power sum alien near end cross talk loss of 51.0 dB at a frequency of 400 MHz.

In yet another embodiment of the present disclosure, the telecommunications cable 100 has the power sum alien near end cross talk loss of 49.5 dB at a frequency of 500 MHz.

The telecommunications cable 100 has a diameter in a range of about 7.8 millimeters±0.7 millimeter. In an embodiment of the present disclosure the telecommunications cable 100 has any other suitable value of diameter. The telecommunications cable 100 includes the plurality of twisted pairs of electrical conductors. Each of the plurality of twisted pairs of electrical conductors extends substantially along the longitudinal axis of the telecommunications cable 100. In an embodiment of the present disclosure, each of the plurality of twisted pairs of insulated conductors is helically twisted along a length of the plurality of twisted pairs of electrical conductors. The plurality of twisted pairs of insulated conductors are helically twisted together to minimize the cross talk in the telecommunications cable 100. In an embodiment of the present disclosure, a number of the plurality of twisted pairs of electrical conductors is 4. In another embodiment of the present disclosure, the number of the plurality of twisted pairs of electrical conductors may vary. Each of the four twisted pair of insulated conductor includes two insulated conductors twisted together along a length of the insulated conductors.

Each insulated conductor of the plurality of twisted pairs of insulated conductors includes an electrical conductor and an insulation layer. In addition, each twisted pair of insulated conductor includes a first electrical conductor and a second electrical conductor. The first electrical conductor is surrounded by a first insulation layer. The second electrical conductor is surrounded by a second insulated layer. Similarly, each of the four twisted pair conductors includes a first electrical conductor surrounded by a first insulation layer and a second electrical conductor surrounded by a second insulated layer. Each electrical conductor is 23 American wire gauge (hereinafter AWG) conductor. In general, AWG is a standardized wire gauge system. The value of wire gauge indicates the diameter of the conductors in the cable.

The telecommunications cable 100 includes the plurality of electrical conductors 120*a-b*. The plurality of electrical conductors 120*a-b* extends substantially along the longitudinal axis of the telecommunications cable 100. The plurality of electrical conductors 120*a-b* are data transmission elements of the telecommunications cable 100. In general, electrical conductors are used in many categories of data transmission, telecommunication, electrical wiring, power generation, power transmission, power distribution, electronic circuitry. The plurality of electrical conductors 120*a-b* are of circular shape. In an embodiment of the present disclosure, the plurality of electrical conductors 120*a-b* are of any other suitable shape.

Each of the plurality of electrical conductors 120*a-b* is characterized by a cross-sectional diameter. In an embodiment of the present disclosure, the cross-sectional diameter of each of the plurality of electrical conductors 120*a-b* is in a range of about 0.570 millimeter±0.050 millimeter. In another embodiment of the present disclosure, the cross-sectional diameter of each of the plurality of electrical conductors 120*a-b* is about 0.570 millimeter. In yet another embodiment of the present disclosure, the cross-sectional diameter of each of the plurality of electrical conductors 120*a-b* may vary. Each of the plurality of electrical conductors 120*a-b* is made of copper.

The telecommunications cable 100 includes the insulation layers 125*a-b*. The insulation layer 125*a* surrounds the electrical conductor 120*a*. The insulation layer 125*b* surrounds the electrical conductor 120*b*. In general, insulators are used in electrical equipment to support and separate electrical conductors. The electric current in the plurality of electrical conductors 120*a-b* cannot pass through the corresponding insulation layers 125*a-b*. The insulation layers 125*a-b* is a protective coating layer over the corresponding electrical conductors 120*a-b*. The insulation layers 125*a-b* provides electrical isolation for each of the corresponding plurality of electrical conductors 120*a-b*. In an embodiment of the present disclosure, the thickness of each of the insulation layers 125*a-b* is in a range of about 0.15 millimeters-0.40 millimeters. In another embodiment of the present disclosure, the insulation layers 125*a-b* may have any other suitable thickness.

In an embodiment of the present disclosure, the insulation layers 125*a-b* is made of a material selected from a group of high density polyethylene and foamed high density polyethylene. In general, high density polyethylene is a polyethylene thermoplastic from polyolefin group. The high density polyethylene material has a high mechanical strength and high electrical resistance. In an embodiment of the present disclosure, the insulation layers 125*a-b* is made of polypropylene. In another embodiment of the present disclosure, the insulation layers 125*a-b* is made of foamed polyethylene. In yet another embodiment of the present disclosure, the insulation layers 125*a-b* is made of foamed polypropylene. In yet another embodiment of the present disclosure, the insulation layers 125*a-b* is made of fluoropolymer. In yet another embodiment of the present disclosure, the insulation layers 125*a-b* is made of combination of some or all of the above mentioned materials.

The telecommunications cable 100 includes the separator 130. The separator 130 extends along a length of the telecommunications cable 100. The separator 130 separates each of the plurality of twisted pairs of insulated conductors from each other. The separator 130 isolates each of the plurality of twisted pairs of insulated conductors from each other. In an embodiment of the present disclosure, the separator 130 separates a core of the telecommunications cable 100 into four sections. Each section includes a pair of twisted insulated conductor along a length of the telecommunications cable 100. In addition, the separator 130 is filler. In an embodiment of the present disclosure, the separator 130 is I-shaped filler.

The separator 130 is made of a material selected from a group. The group consists of low smoke zero halogen and medium density polyethylene material. In general, low smoke zero halogen is a type of plastic used in the wire and cable industry for improving performance of cables and wires. In addition, low smoke zero halogen is custom compound designed to produce minimal smoke and no halogen during exposure to fire. In an embodiment of the present disclosure, the I-shaped filler is made of foamed polyethylene. In another embodiment of the present disclosure, the I-shaped filler is made of polyethylene. In yet another embodiment of the present disclosure, the I-shaped filler is made of poly vinyl chloride. In yet another embodiment of the present disclosure, the I-shaped filler is made of polypropylene. In yet another embodiment of the present disclosure, the I-shaped filler is made of foamed polypropylene. In yet another embodiment of the present disclosure, the I-shaped filler is made of combination of a number of materials. The materials includes low smoke zero halogen, foamed polyethylene, polyethylene, low smoke zero halogen, poly vinyl chloride, polypropylene and foamed polypropylene.

The separator 130 includes a central section 135*a*, a first section 135*b* and a second section 135*c*. The central section 135*a*, the first section 135*b* and the second section 135*c* extend along the length of the telecommunications cable 100. The first section 135*b* is a first vertical section of the separator 130. The second section 135*c* is a second vertical section of the separator 130. The central section 135*a* is a third vertical section of the separator 130. The central section 135*a* is in between the first section 135*b* and the second section 135*c*. The first section 135*b* and the second section 135*c* are defined by predefined dimensions. The predefined dimensions are defined by a predefined distance, a predefined height, a predefined thickness and a predefined length, the central section 135*a* has a height of around the collective predefined heights of the first section 135*b* and the second section 135*c*. The first section 135*b* and the second section 135*c* have an equal height. The first section 135*b* is on a first side of the central section 135*a*. The second section 135*c* is on a second side of the central section 135*a*. A length of the first section 135*b* and the second section 135*c* is substantially equal. The central section 135*a*, the first section 135*b* and the second section 135*c* are mutually parallel to each other. The central section 135*a* is placed at a center of the telecommunications cable 100. The center of the central section 135*a* coincides with a center of the telecommunications cable 100. The central section 135*a* is placed equidistant from the first section 135*b* and the second section 135*c*. The first section 135*b* and the second section 135*c* are placed opposite to each other on each side of the central section 135*a*. The center of the first section 135*b* and the second section 135*c* lies on a straight line. The straight line passes through the center of the central section 135*a*. The first section 135*b* and the second section 135*c* are positioned parallel to the central section 135*a* on either side of the central section 135*a*.

The central section 135*a*, the first section 135*b* and the second section 135*c* are characterized by a height. The height of the first section 135*b* and the second section 135*c* is same. The height of the central section 135*a* is greater than the height of the first section 135*b* and the second section 135*c*. The first section 135*b* and the second section 135*c* have the height in a range of about 3 millimeters+−1.6 millimeters. The central section 135*a* has the height in a range of about 6 millimeters+−1 millimeter. The separator 130 is characterized by a width. The width of the separator 130 corresponds to a distance or width between the first section 135*b* and the second section 135*c*. The distance between the first section 135*b* and the second section 135*c* is in a range of about 5.8 millimeters+−0.5 millimeters.

Further, the separator 130 includes cross section filler. The cross section filler includes a first cross section 140*a* and a second cross section 140*b*. The first cross section 140*a* and the second cross section 140*b* extends along the length of the telecommunications cable 100. The center of the first cross section 140*a* and the second cross section 140*b* coincides with the center of the telecommunications cable 100. In addition, the center of the central section 135*a* coincides with a terminal of first cross section 140*a* and a terminal of the second cross section 140*b*. The first cross section 140*a* is perpendicular to the first section 135*b* and the central section 135*a*. The first cross section 140*a* is a first horizontal section lying in between the first section 135*b* and the central section 135*a*. The first cross section 140*a* divides the central section 135*a* and the first section 135*b* equally from the first side of the central section 135*a*.

The second cross section 140*b* is perpendicular to the second section 135*c* and the central section 135*a*. The second cross section 140*b* is a second horizontal section lying in between the second section 135*c* and the central section 135*a*. The second cross section 140*b* divides the central section 135*a* and the second section 135*c* equally from the second side of the central section 135*a*. A length of the first cross section 140*a* and the second cross section 140*b* is substantially equal. The first cross section 140*a* and the second cross section 140*b* pass through the center of the first section 135*b*, the central section 135*a* and the second section 135*c*. The length of the first cross section 140*a* is equal to a distance between the central section 135*a* and the first section 135*b*. In addition, the length of the second cross section 140*b* is equal to a distance between the central section 135*a* and the second section 135*c*.

In an embodiment of the present disclosure, the telecommunications cable 100 has a first side and a second side. The first side of the telecommunications cable 100 includes the first section 135*b*, the first cross section 140*a*, the second volumetric section 145*b* and the third volumetric section 145*c*.

In an example, the first side of the telecommunication cable 100 is the left side portion of the telecommunication cable 100 with respect to the central section 135*a*. The second side of the telecommunications cable 100 includes the second section 135*c*, the second cross section 140*b*, the first volumetric section 145*a* and the fourth volumetric section 145*d*. In an example, the second side of the telecommunication cable 100 is the right side portion of the telecommunication cable 100 with respect to the central section 135*a*. In another example, if an imaginary line is drawn extending the central section 135*a* upwards and downwards to a point that it touches the telecommunication cable 100, then the entire left portion inside the telecommunication cable 100 with respect to the imaginary line is the first side of the telecommunication cable 100 and the entire right portion inside the telecommunication cable 100 with respect to the imaginary line is the second side of the telecommunication cable 100. In yet another example, the first side of the telecommunication cable 100 is called as the first side of the central section 135*a*. In yet another example, the second side of the telecommunication cable 100 is called as the second side of the central section 135*a*.

The first section 135*b* is on the first side of the central section 135*a*. The second section 135*c* is on the second side of the central section 135*a*. The first cross section 140*a* divides the central section 135*a* equally from the first side of the central section 135*a*. The second cross section 140*b* divides the central section 135*a* equally from the second side of the central section 135*a*.

The central section 135*a*, the first section 135*b*, the second section 135*c*, the first cross section 140*a* and the second cross section 140*b* are characterized by a thickness. The central section 135*a* has a thickness in a range of about 0.3 millimeter-0.7 millimeter. The first section 135*b* has a thickness in a range of about 0.35 millimeter-0.55 millimeter. The second section 135*c* has a thickness in a range of about 0.35 millimeter-0.55 millimeter. The first cross section 140*a* has a thickness in a range of about 0.5 millimeter-0.7 millimeter. The second cross section 140*b* has a thickness in a range of about 0.5 millimeter-0.7 millimeter.

The separator 130 is characterized by a dielectric constant. The dielectric constant has a first value and a second value. In an embodiment of the present disclosure, the dielectric constant has a first value in a range of about 3.5±0.3 when the separator is made of Low smoke zero halogen. In another embodiment of the present disclosure, the dielectric constant has a second value in range of about 2.3±0.3 when the separator is made of medium density polyethylene. The separator 130 is characterized by an elongation. The elongation has a first value and a second value. In an embodiment of the present disclosure, the elongation has the first value of about 300%-800% when the separator 130 is made of medium density polyethylene. In an embodiment of the present disclosure, the elongation has the second value of about 100%-300% when the separator 130 is made of low smoke zero halogen. The separator 130 is characterized by a tensile strength. The tensile strength has a first value and a second value. In an embodiment of the present disclosure, the tensile strength has the first value of about 12-20 N/Sq mm when the separator 130 is made of medium density polyethylene. In an embodiment of the present disclosure, the tensile strength has the second value of about 7-15 N/Sq mm when the separator 130 is made of low smoke zero halogen.

The first cross section 140*a* and the second cross section 140*b* divides the first section 135*b*, the central section 135*a* and the second section 135*c* into four sections. The arrangement of the first section 135*b*, the central section 135*a* and the second section 135*c* is collectively termed as the I-shaped filler. The I-shaped filler is uniform in shape along the entire length of the telecommunications cable 100.

The I-shaped filler is designed to enhance performance of the telecommunications cable 100. The I-shaped filler protects the telecommunications cable 100 against alien cross talk. The I-shaped filler of the telecommunications cable 100 provides protection against alien cross talk from surrounding cables at all ranges of frequency. The first section 135*b* and the second section 135*c* prevent the I-shaped filler from collapsing during manufacturing of the telecommunications cable 100. The first section 135*b* and the second section 135*c* prevents the I-shaped filler from collapsing while placing electrical element in the I-shaped filler. The I-shaped filler increases the production speed of the telecommunications cable 100. The increase in production speed is due to the reduction in the number of variation required on buncher. The variation on buncher is produced to minimize alien cross talk. The I-shaped filler eliminates alien cross talk in telecommunications cable 100. The production speed of the telecommunications cable 100 is increased due to I-shaped filler requiring minimum variation on buncher.

The telecommunications cable includes four volumetric sections 145*a-d*. The four volumetric sections include a first volumetric section 145*a*, a second volumetric section 145*b*, a third volumetric section 145*c* and a fourth volumetric section 145*d*. The first volumetric section 145*a*, the second volumetric section 145*b*, the third volumetric section 145*c* and the fourth volumetric section 145*d* have equal cross sectional volume. Each volumetric section of the four volumetric sections 145*a-d* provides housing space for the data transmission element. Each volumetric section of the four volumetric sections 145*a-d* includes one pair of twisted insulated conductors. The telecommunications cable 100 includes a total of eight (4×2) electrical conductors.

In an embodiment of the present disclosure, the material of the insulation layers 125*a-b* has a different dielectric constant than a dielectric constant of the material of the I-shaped filler. In general, the dielectric constant is a ratio of a permittivity of a substance to a permittivity of free space. In addition, the dielectric constant is an expression of the extent to which a material concentrates electric flux. The dielectric constant of the I-shaped filler material is more than the dielectric constant of the material of the insulation layers 125*a-b* of the telecommunications cable 100. The difference in dielectric constant gives stable result of alien Cross talk test at higher frequency. The difference in dielectric constant of the material of the insulating layers 125*a-b* and the I-shaped filler material enables improvement in the electrical and magnetic properties of the telecommunications cable 100. In an embodiment of the present disclosure, the dielectric constant of the material of the I-shaped filler and dielectric constant of the material of the insulation layer is different at any point of the telecommunications cable 100.

The telecommunications cable 100 includes the first layer 150. The first layer 150 is an outermost layer of the telecommunications cable 100. The first layer 150 is of circular cross section. The first layer 150 is a protective outer covering for the telecommunications cable 100. The first layer 150 protects the telecommunications cable 100 from moisture, abrasion, magnetic fields, radiation and different environmental conditions. The first layer 150 has a thickness in a range of about 0.4 millimeter-2.5 millimeters.

The first layer 150 is made of a material selected from a group of low smoke zero halogen material, polyethylene and PVC. In general, poly vinyl chloride is a synthetic resin made from polymerization of vinyl chloride. In general, polyethylene is a light versatile synthetic resin made from the polymerization of ethylene. In an embodiment of the present disclosure, the first layer 150 is made of fire retardant poly vinyl chloride. In another embodiment of the present disclosure, the first layer 150 is made of fluoropolymer.

Further, the telecommunications cable 100 includes one or more ripcords. In an embodiment of the present disclosure, the telecommunications cable 100 includes a ripcord 155. The one or more ripcords are placed inside a core of the telecommunications cable 100. The one or more ripcords lie substantially along the longitudinal axis of the telecommunications cable 100. The one or more ripcords facilitate stripping of the first layer 150. In an embodiment of the present disclosure, the one or more ripcords are made of a material selected from a group. The group consists of nylon and polyester based twisted yarns. The telecommunications cable 100 has a diameter in a range of about 7.8 millimeters±0.7 millimeter.

In an embodiment of the present disclosure, the telecommunications cable 100 includes a plurality of identification stripes 160*a-d*. Each identification stripe is located on an insulation layer of one electrical conductor in each volumetric section. Each of the plurality of identification stripes 160*a-d* is used for identification of each twisted pair of insulated conductor. In an embodiment of the present disclosure, the insulation layer of each of the plurality of twisted pairs of insulated conductors in each of the four volumetric section is colored. In an embodiment of the present disclosure, the insulation layer of the second electrical conductor in each of the four volumetric sections 145*a-d* is colored. The color of the insulation layer of the second electrical conductor of the two electrical conductors in each of the four volumetric sections is selected from a group. The group includes blue, orange, green and brown. In an embodiment of the present disclosure, the group includes any other suitable colors. In an embodiment of the present disclosure, the insulation layer of the first electrical conductor of the two conductors in each of the volumetric area section is white. The white colored insulation layer of the first electrical conductor in each of the four volumetric sections 145*a-d* is marked with colored identification stripe 160*a-d*. The color of the identification stripe 160*a-d* on the insulation layer of each of the first electrical conductor is same as the color of the insulation layer of the adjacent second electrical conductor in each of the four volumetric sections 145*a-d*. In an embodiment of the present disclosure, the identification stripe 160*a-d* on the insulation layer of the first electrical conductor in each of the four volumetric sections 145*a-d* is of any other suitable color. In another embodiment of the present disclosure, the telecommunications cable 100 may not include the plurality of identification stripes 160*a-d*.

The telecommunications cable 100 has a lower overall diameter. The diameter is minimized or lowered by using the I-shaped filler of reduced dimensions. In addition, the telecommunications cable 100 is cost effective. The reduction in cost is due to reduction in material consumption.

The present disclosure provides numerous advantages over the prior art. The telecommunications cable includes I-shaped filler. The telecommunications cable has reduced alien cross talk. The telecommunications cable has higher flame resistance. The telecommunications cable generates lower smoke. The telecommunications cable has higher machine speed on buncher during production of the telecommunications cable. The telecommunications cable has higher machine speed on filler line during production of the telecommunications cable. The telecommunications cable has higher machine speed on sheathing line during production of the telecommunications cable. The telecommunications cable is provided with firm positioning of twisted pair of insulated conductors. The different dielectric constant of the material of the separator from the material of the insulation layer reduces the alien cross talk. In addition, the telecommunications cable with the I-shaped filler has improved electrical performance. The telecommunications cable has reduced overall diameter. The telecommunications cable is cost effective by reducing the consumption of material.

The foregoing descriptions of specific embodiments of the present technology have been presented for purposes of illustration and description. They are not intended to be exhaustive or to limit the present technology to the precise forms disclosed, and obviously many modifications and variations are possible in light of the above teaching. The embodiments were chosen and described in order to best explain the principles of the present technology and its practical application, to thereby enable others skilled in the art to best utilize the present technology and various embodiments with various modifications as are suited to the particular use contemplated. It is understood that various omissions and substitutions of equivalents are contemplated as circumstance may suggest or render expedient, but such are intended to cover the application or implementation without departing from the spirit or scope of the claims of the present technology.

What is claimed is:

1. A separator for use in a telecommunications cable, the separator comprising:

a first section extending along a length of the telecommunications cable, wherein the first section is a first vertical section of the separator;

a second section extending along the length of the telecommunications cable, wherein the second section is a second vertical section of the separator;

a central section extending along the length of the telecommunications cable, wherein the central section is a third vertical section of the separator, wherein the central section is an open-ended section, wherein the central section is in between the first section and the second section, wherein the first section and the second section are positioned parallel to the central section;

a first cross section extending along the length of the telecommunications cable, wherein the first cross section is a first horizontal section in between the first section and the central section, and a second cross section extending along the length of the telecommunications cable, wherein the second cross section is a second horizontal section lying in between the second section and the central section;

wherein the first section and the second section have different thickness than the first cross section and the second cross section;

whereby the separator physically separates the telecommunications cable into a first volumetric section, a second volumetric section, a third volumetric section and a fourth volumetric section to reduce cross-talk at a plurality of operational frequencies.

2. The separator as claimed in claim 1, wherein at least one of:

the first cross section is perpendicular to the first section and the central section, the first cross section tangibly divides the central section and the first section equally from a first side of the central section, the first section is on the first side of the central section, wherein the second section is on a second side of the central section, the second cross section is perpendicular to the second section and the central section, the second cross section tangibly divides the central section and the second section equally from the second side of the central section, a center of the central section coincides with a center of the telecommunications cable, and the central section is placed equidistant from the first section and the second section.

3. The separator as claimed in claim 1, wherein at least one of:

the separator separates each of a plurality of twisted pairs of insulated conductors from each other in the telecommunications cable, and the separator separates a core of the telecommunications cable into four equal sections.

4. The separator as claimed in claim 1, wherein the separator is I-shaped filler.

5. The separator as claimed in claim 1, wherein at least one of:

the first section and the second section have a predefined height in a range of 1.4 millimeters to 4.6 millimeters, the central section has a height in a range of 5 millimeters to 7 millimeters, a predefined distance between the first section and the second section is in a range of 5.3 millimeters to 6.3 millimeters, the central section has a thickness in a range of 0.3 millimeter-0.7 millimeter, the first section has a predefined thickness in a range of 0.35 millimeter-0.55 millimeter, the second section has a predefined thickness in a range of 0.35 millimeter-0.55 millimeter, the first cross section has a thickness in a range of 0.5 millimeter-0.7 millimeter, the second cross section has a thickness in a range of 0.5 millimeter-0.7 millimeter, the central section has a height of around the collective predefined heights of the first section and the second section, and the first section and the second section have an equal height.

6. The separator as claimed in claim 1, wherein the separator is made of a material selected from a group consisting of low smoke zero halogen and medium density polyethylene.

7. The separator as claimed in claim 1, wherein at least one of:

the separator is characterized by a dielectric constant, wherein the dielectric constant has a first value in a range of 3.2 to 3.8 when the separator is made of low smoke zero halogen, the separator is characterized by a dielectric constant, wherein the dielectric constant has a second value in a range of 2.0 to 2.6 when the separator is made of medium density polyethylene, the separator is characterized by an elongation, wherein the elongation has a first value in a range of 300%-800% when the separator is made of medium density polyethylene, the separator is characterized by an elongation, wherein the elongation has a second value in a range of 100%-300% when the separator is made of low smoke zero halogen, the separator is characterized by a tensile strength, wherein the tensile strength has a first value in a range of 12-20 N/Sq mm when the separator is made of medium density polyethylene, and the separator is characterized by a tensile strength, wherein the tensile strength has a second value in a range of 7-15 N/Sq mm when the separator is made of low smoke zero halogen.

8. A telecommunications cable comprising:

a plurality of twisted pairs of insulated conductors extending substantially along a longitudinal axis of the telecommunications cable;

a separator, wherein the separator comprising:

a first section extending along a length of the telecommunications cable, wherein the first section is a first vertical section of the separator;

a second section extending along the length of the telecommunications cable, wherein the second section is a second vertical section of the separator;

a central section extending along the length of the telecommunications cable, wherein the central section is a third vertical section of the separator, wherein the central section is an open-ended section, wherein the central section is in between the first section and the second section, wherein the first section and the second section are positioned parallel to the central section;

a first cross section extending along the length of the telecommunications cable, wherein the first cross section is a first horizontal section in between the first section and the central section; and a second cross section extending along the length of the telecommunications cable, wherein the second cross section is a second horizontal section lying in between the second section and the central section;

wherein the first section and the second section have different thickness than the first cross section and the second cross section;

wherein the separator physically separates the plurality of twisted pairs of insulated conductors to reduce cross-talk at a plurality of operational frequencies.

9. The telecommunications cable as claimed in claim 8, wherein the telecommunications cable further comprising:

a first layer, and one or more ripcords, wherein at least one of:

the first layer has a thickness in a range of 0.4 millimeter-2.5 millimeters, the first layer is made of a material selected from a group of low smoke zero halogen material, polyethylene and PVC, and the one or more ripcords are made of a material selected from a group of nylon and polyester based twisted yarns.

10. The telecommunications cable as claimed in claim 8, wherein at least one of:

the first cross section is perpendicular to the first section and the central section, the first cross section tangibly divides the central section and the first section equally from a first side of the central section, the first section and the second section are positioned parallel to the central section, the first section is on the first side of the central section, wherein the second section is on a second side of the central section, the second cross section is perpendicular to the second section and the central section, the second cross section tangibly divides the central section and the second section equally from the second side of the central section, a center of the central section coincides with a center of the telecommunications cable, and the central section is placed equidistant from the first section and the second section.

11. The telecommunications cable as claimed in claim 8, wherein at least one of:

the separator separates each of a plurality of twisted pairs of insulated conductors from each other in the telecommunications cable, and the separator separates a core of the telecommunications cable into four equal sections.

12. The telecommunications cable as claimed in claim 8, wherein the separator is I-shaped filler.

13. The telecommunications cable as claimed in claim 8, wherein at least one of:

the first section and the second section have a predefined height in a range of 1.4 millimeters to 4.6 millimeters, the central section has a height in a range of 5 millimeters to 7 millimeters, a predefined distance between the first section and the second section is in a range of 5.3 millimeters to 6.3 millimeters, the central section has a thickness in a range of 0.3 millimeter-0.7 millimeter, the first section has a predefined thickness in a range of 0.35 millimeter-0.55 millimeter, the second section has a predefined thickness in a range of 0.35 millimeter-0.55 millimeter, the first cross section has a thickness in a range of 0.5 millimeter-0.7 millimeter, the second cross section has a thickness in a range of 0.5 millimeter-0.7 millimeter, the central section has a height of around the collective predefined heights of the first section and the second section, and the first section and the second section have an equal height.

14. The telecommunications cable as claimed in claim 8, wherein each insulated conductor of a plurality of twisted pairs of insulated conductors further comprising one electrical conductor, an insulation layer, wherein at least one of:

a cross-sectional diameter of each of the electrical conductor is in a range of 0.570 millimeter±0.050 millimeter, the thickness of each of the insulation layers is in a range of 0.15 millimeters-0.40 millimeters, the insulation layer is made of a material selected from a group of high density polyethylene and foamed high density polyethylene.

15. The telecommunications cable as claimed in claim 8, wherein the separator is made of a material selected from a group consisting of low smoke zero halogen and medium density polyethylene.

16. The telecommunications cable as claimed in claim 8, wherein at least one of:

the separator is characterized by a dielectric constant, wherein the dielectric constant has a first value in a range of 3.2 to 3.8 when the separator is made of low smoke zero halogen, the separator is characterized by a dielectric constant, wherein the dielectric constant has a second value in a range of 2.0 to 2.6 when the separator is made of medium density polyethylene, the separator is characterized by an elongation, wherein the elongation has a first value in a range of 300%-800% when the separator is made of medium density polyethylene, the separator is characterized by an elongation, wherein the elongation has a second value in a range of 100%-300% when the separator is made of low smoke zero halogen, the separator is characterized by a tensile strength, wherein the tensile strength has a first value in a range of 12-20 N/Sq mm when the separator is made of medium density polyethylene, the separator is characterized by a tensile strength, wherein the tensile strength has a second value in a range of 7-15 N/Sq mm when the separator is made of low smoke zero halogen.

17. The telecommunications cable as claimed in claim 8, wherein the telecommunications cable has a diameter in a range of 7.8 millimeters±0.7 millimeter.

18. A telecommunications cable comprising:

a plurality of twisted pairs of insulated conductors extending substantially along a longitudinal axis of the telecommunications cable, a separator, wherein the separator is I-shaped filler that physically separates the plurality of twisted pairs of insulated conductors to reduce cross-talk at a plurality of operational frequencies.

19. The telecommunications cable as claimed in claim 18, wherein the separator further comprising:

a first section extending along a length of the telecommunications cable, wherein the first section is a first vertical section of the separator;

a second section extending along the length of the telecommunications cable, wherein the second section is a second vertical section of the separator;

a central section extending along the length of the telecommunications cable, wherein the central section is a third vertical section of the separator, wherein the central section is an open-ended section, wherein the central section is in between the first section and the second section, wherein the first section and the second section are positioned parallel to the central section a first cross section extending along the length of the telecommunications cable, wherein the first cross section is a first horizontal section in between the first section and the central section, a second cross section extending along the length of the telecommunications cable, wherein the second cross section is a second horizontal section lying in between the second section and the central section.

20. The telecommunications cable as claimed in claim 19, wherein at least one of:

the first cross section is perpendicular to the first section and the central section, the first cross section tangibly divides the central section and the first section equally from a first side of the central section, the first section and the second section are positioned parallel to the central section, the first section is on the first side of the central section, wherein the second section is on a second side of the central section, the second cross section is perpendicular to the second section and the central section, the second cross section tangibly divides the central section and the second section equally from the second side of the central section, a center of the central section coincides with a center of the telecommunications cable, the central section is placed equidistant from the first section and the second section, the separator separates each of the plurality of twisted pairs of insulated conductors from each other in the telecommunications cable, the separator separates a core of the telecommunications cable into four equal sections.

21. The telecommunications cable as claimed in claim 18, wherein the separator is made of a material selected from a group consisting of low smoke zero halogen and medium density polyethylene.

* * * * *